US007637624B2

(12) United States Patent
Chin

(10) Patent No.: US 7,637,624 B2
(45) Date of Patent: Dec. 29, 2009

(54) COOKING DEVICE

(75) Inventor: Jae Myeung Chin, Gimhae (KR)

(73) Assignee: LG Electronics Inc., Seoul (KR)

( * ) Notice: Subject to any disclaimer, the term of this patent is extended or adjusted under 35 U.S.C. 154(b) by 242 days.

(21) Appl. No.: 11/802,890

(22) Filed: May 25, 2007

(65) Prior Publication Data

US 2007/0272682 A1 Nov. 29, 2007

(30) Foreign Application Priority Data

May 29, 2006 (KR) ..... 10-2006-0048268

(51) Int. Cl.
*F21V 33/00* (2006.01)

(52) U.S. Cl. ..... 362/92; 126/198

(58) Field of Classification Search ..... 362/92; 219/758; 126/198
See application file for complete search history.

(56) References Cited

U.S. PATENT DOCUMENTS 5,676,459 A * 10/1997 Bedford et al. ..... 362/390
6,361,181 B1 * 3/2002 Bales ..... 362/92
7,091,459 B2 * 8/2006 Kim ..... 219/758

FOREIGN PATENT DOCUMENTS

| | | |
|---|---|---|
| CN | 1162722 | 10/1997 |
| KR | 95-19782 | 7/1995 |
| KR | 10-2001-0026308 | 4/2001 |

OTHER PUBLICATIONS

Korean Office Action dated Apr. 5, 2007.

* cited by examiner

*Primary Examiner*—Stephen F Husar
*Assistant Examiner*—James W Cranson
(74) *Attorney, Agent, or Firm*—KED & Associates, LLP

(57) ABSTRACT

A cooking device is provided in which damage to a lamp that provides light to a cooking cavity may be prevented. The lamp may be mounted in a lighting assembly and coupled to an outer surface of the cavity by a mounting assembly. The mounting assembly provides for limited movement of the lighting assembly relative to the cavity. Any external shocks or vibrations imparted on the cavity may be attenuated through this limited movement, thus reducing or eliminating forces transmitted to the lighting assembly and preventing damage to the lamp.

14 Claims, 4 Drawing Sheets

COOKING DEVICE

This claims the benefit of Korean Patent Application No. 2006-0048268 filed in Korea on May 29, 2006, the entirety of which is incorporated herein by reference.

BACKGROUND

1. Field

This relates to a cooking device, and more particularly, to a cooking device with a lamp for illuminating a cooking space.

2. Background

In general, a cooking device is a device for cooking food, and may include, for example, a conventional oven, a convection oven, a microwave oven, a combination microwave/convection oven and the like. Recently, microwave oven ranges have become available. These ranges cook food using microwave and/or high temperature heat simultaneously or selectively.

Typically, in devices for cooking food using microwaves as a heat source, a lighting unit is installed at an outer surface of a cavity that defines a cooking space. The lighting unit is positioned so as to avoid any risk in safety due to, for example, sparks generated when the lighting unit is influenced by microwaves. However, if external shocks are exerted on the cavity, these external shocks may be transmitted to the lighting unit, and may damage or disable the lighting unit. For example, if the lighting unit includes a lamp having a filament, the filament may become thin due to exposure to high temperatures. If an external shock is exerted on the lamp, the filament may be disconnected or damaged. The external shock may include, for example, a shock generated when a door of the cooking device is opened or closed, a shock generated when the cooking device collides with other devices, a shock caused by a vibration generated when the cooking device operates, and other such sources of external shock.

BRIEF DESCRIPTION OF THE DRAWINGS

The embodiments will be described in detail with reference to the following drawings in which like reference numerals refer to like elements wherein.

DETAILED DESCRIPTION

Figure 1:
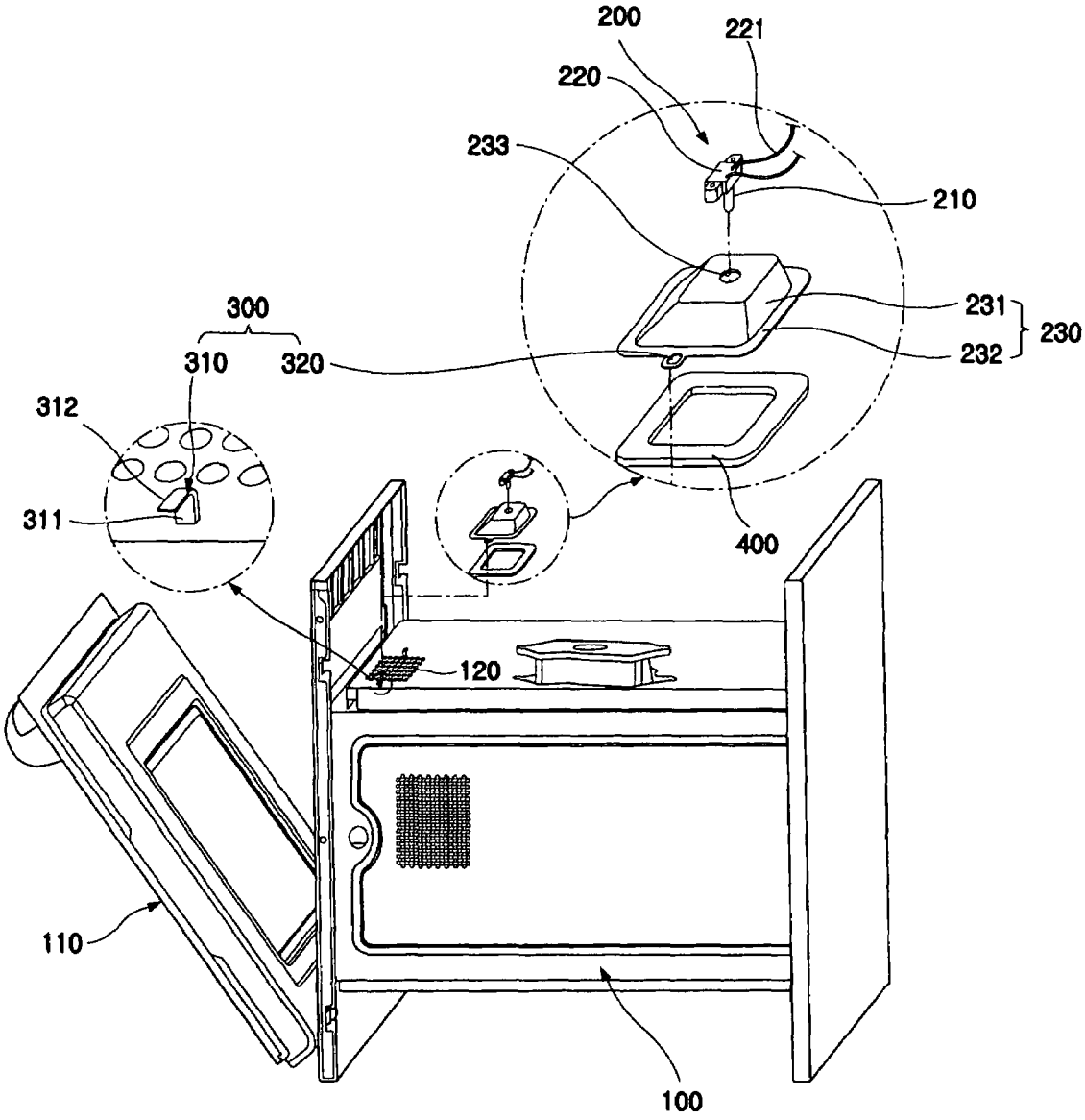
FIG. 1 is an exploded perspective view of a coupling structure of a lighting assembly and a cavity of a cooking device in accordance with an embodiment as broadly described herein.
Figure 2:
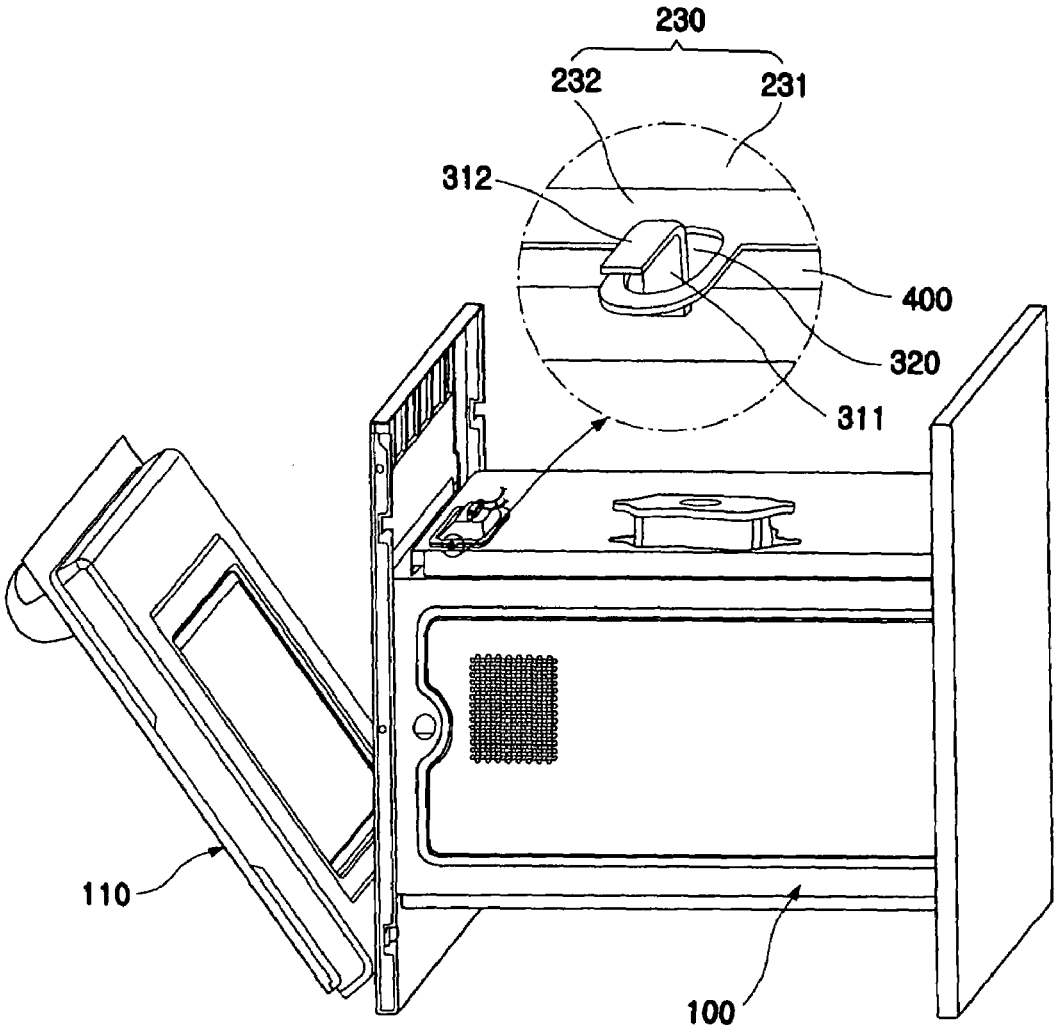
FIG. 2 is an assembled perspective view of the lighting assembly coupled to the cavity shown in FIG. 1, in accordance with an embodiment as broadly described herein.

FIGS. 1 and 2 illustrate a cooking device in accordance with an embodiment as broadly described herein. The cooking device may include a cavity 100, a lighting assembly 200 and a mounting assembly 300. The cavity 100 may define a cooking space with an open front portion that may be opened or closed by a door 110. A plurality of communication holes 120 may be formed in an upper wall of the cavity 100. The holes 120 may provide for communication between an interior of the cavity 100 and an interior of an accommodating chamber 231. Embodiments of the lighting assembly 200 and mounting assembly 300 for a cooking device as broadly described herein may be adapted for use on numerous types of cooking devices as appropriate. A more detailed discussion of the components and operation of a microwave oven and/or a combination microwave and convection oven can be found in Korean Patent Application Nos. 10-2006-0084335, 10-2006-0088289, 10-2006-0088293, 10-2006-0088288, 10-2006-0088294, 10-2006-0088295, 10-2006-0088296, and 2006-0048267, the entirety of which is incorporated herein by reference.

The lighting assembly 200 may provide light to the interior of the cavity 100, and may be installed at an outer surface of the upper wall of the cavity 100. Other locations may also be appropriate. For example, the lighting assembly 200 may be provided at a side wall of the cavity 100, or alternatively at a rear or lower wall of the cavity 100, based on the type of cooking device and other such considerations. The lighting assembly 200 may include a lamp 210 that emits light, a lamp holder 220 and a lamp cover 230. In certain embodiments, a halogen lamp may be used as the lamp. Other types of lamps may also be appropriate. The lamp holder 220 may direct electric power to the lamp 210. For example, the lamp 210 may be mounted to the lamp holder 220, and various kinds of electric wires 221 and the like may be connected therebetween.

The lamp cover 230 may protect the lamp 210 from external environmental effects. The lamp 210 may be received in the accommodating chamber 231 defined by the lamp cover 230. The lamp cover 230 may also include a circumference portion 232 bent outward from the accommodating chamber 231 to form a peripheral portion of the accommodating chamber 231 that contacts the upper surface of the cavity 100. The lamp 210 may extend through a hole 233 formed in an upper wall of the accommodating chamber 231 and into the accommodating chamber 231. The lamp holder 220 may be mounted on the upper wall of the accommodating chamber 231 by fasteners 234, such as, for example, screws or other suitable fasteners.

Figure 3:
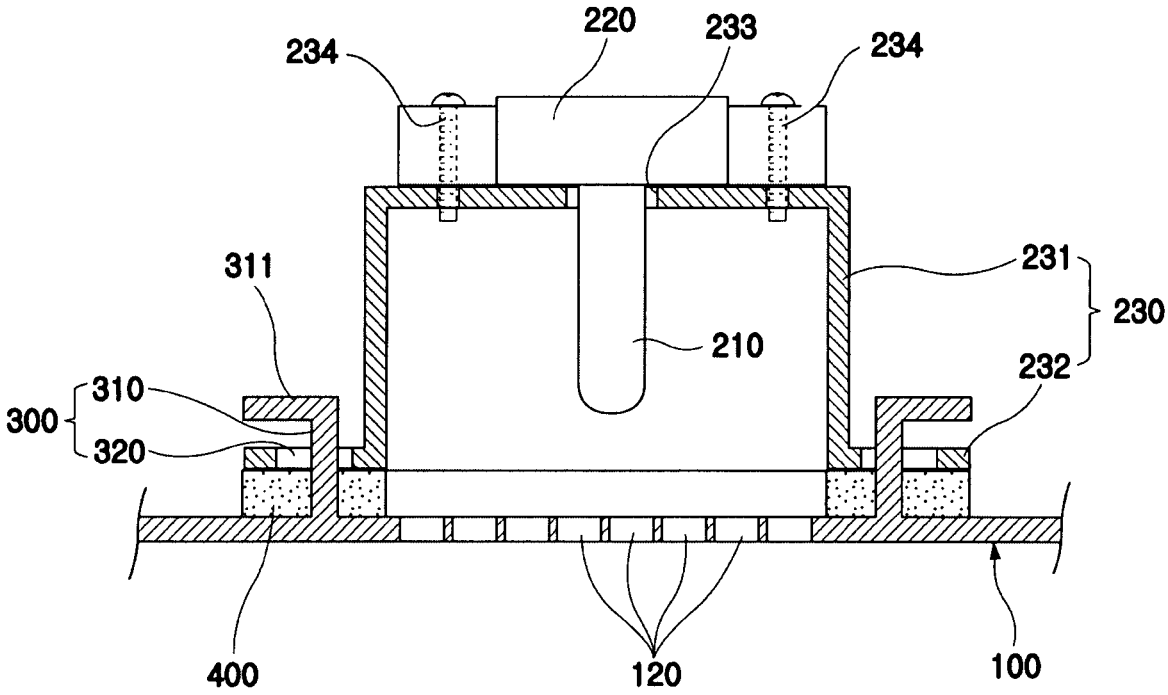
FIG. 3 is a sectional view of the lighting assembly coupled to the cavity shown in FIGS. 1 and 2, in accordance with an embodiment as broadly described herein.

The mounting assembly 300 may couple the lamp cover 230 to the cavity 100 such that the lamp cover 230 floats, or is allowed some limited movement relative to the outer wall of the cavity 100, as shown in FIGS. 2 and 3. The mounting assembly 300 may include engaging protrusions 310 and engaging holes 320. Engaging protrusions 310 may be provided on at least one side of the outer surface of the cavity 100 where the lamp cover 230 is installed. In the embodiment shown in FIGS. 2 and 3, engaging protrusions 310 are provided on two opposite sides of the outer surface of the cavity 100 where the lamp cover 230 is installed. Other arrangements may also be appropriate. Each of the engaging protrusions 310 may include a protrusion section 311 that extends outward from the outer surface of the cavity 100 and a bent section 312 extending at a bend from an end portion of the protrusion section 311. The engaging holes 320 may be formed in the circumference portion 232 of the lamp cover 230, at positions corresponding to the engaging protrusions 310.

In the embodiment shown in FIGS. 1-3, the engaging holes 320 are formed in the shape of a slot, thus allowing the engaging protrusion 310 to be smoothly coupled to the corresponding engaging hole 320. This shape may minimize any interference between the bending section 312 and the engaging hole 320 when the engaging protrusion 310 is inserted into the engaging hole 320. Accordingly, as the engaging protrusion 310 passes through the engaging hole 320, the bending section 312 of the engaging protrusion 310 engages an upper surface of the circumference portion 232 of the lamp cover 230, thus preventing the lamp cover 230 from being detached from the cavity 100.

In certain embodiments, the engaging hole 320 may have a width that is larger than a thickness or a width of the engaging protrusion 310. This allows the lamp cover 230 to float, or have some limited movement relative to the cavity 100, in the direction perpendicular to the coupling direction of the lamp cover 230 and the cavity 100. This movement is limited by the clearance between the engaging hole 320 and the engaging protrusion 310. In the embodiment shown in FIGS. 1-3, the clearance between the engaging protrusion 310 and the engaging hole 320 allows the lamp cover 230 to move horizontally relative to the cavity 100, or in a circumferential direction of the cavity 100. This allows shocks and vibrations transmitted in a corresponding direction to be attenuated through this clearance, and not be transmitted to the lamp cover 230, lighting assembly 220 and lamp 210 coupled thereto. That is, although shocks and vibrations may be imparted on the cavity 100, any shocks and vibrations transmitted in the circumferential direction can be attenuated, so that any residual shocks and vibrations transmitted to the lamp cover 230 may be minimized, thus preventing damage to the lamp 210 coupled to the lamp cover 230.

Furthermore, a gap between the outer surface of the cavity 100 and the bending section 311 of the engaging protrusion 310 may be larger than a thickness of the circumference portion 232. This provides a clearance between the lamp cover 230 and the cavity 100, allowing limited movement of the lamp cover 230 in the coupling direction of the lamp cover 230 and the cavity, and providing additional shock and vibration attenuation. In the embodiment shown in FIGS. 1-3, the clearance between the lamp cover 230 and the cavity 100 allows the lamp cover 230 to move vertically relative to the cavity 100, thus allowing vertically oriented shocks and vibrations imparted on the cavity 100 to be attenuated through this clearance, so that any residual shocks and vibrations transmitted to the lamp cover 230 may be minimized and damage to the lamp 210 coupled to the lamp cover 230 may be avoided.

A blocking assembly 400 may be provided to fill a gap between the lighting assembly 200 and the cavity 100, and to absorb shocks and vibrations transmitted from the cavity 100 to the lighting assembly 200. By filling the gap between the lighting assembly 200 and the cavity 100, the blocking assembly 400 may prevent light emitted by the lamp 210 from leaking to the outside. Additionally, the blocking assembly 400, together with the mounting assembly 300, may provide for additional attenuation and absorption of shocks and vibrations. The blocking assembly 400 may be positioned between confronting surfaces of the circumference portion 232 of the lamp cover 230 and the cavity 100. The blocking assembly 400 may be fixed to at least one of these two confronting surfaces. The blocking assembly 400 may be made of a resilient material, such as, for example, sponge or other such cushioning material so as to absorb shocks and vibrations and prevent light emitted by the lamp 210 from leaking to the outside.

Consequently, in a lighting assembly 200 mounted using a mounting assembly 300 as described above, a shock generated when the door 110 is opened or closed, or a shock caused by carelessness in use, may be attenuated, and damage to the lamp 210 of the lighting assembly 200 may be prevented. That is, shocks and vibrations transmitted through the cavity 100 may be partially attenuated through the clearance between the engaging protrusion 310 and the engaging hole 320 and the clearance between the bent section 311 of the engaging protrusion 310 and an upper surface of the cavity 100. Additionally, shocks and vibrations may also be absorbed by the blocking assembly 400. In this manner, residual shocks and vibrations, if any, which may be transmitted to the lamp cover 230 may be minimized, and damage to the lamp 210 mounted on the lamp cover 230 may be prevented.

Even if an excessive shock or vibration is exerted, causing the engaging protrusion 310 and the engaging hole 320 to collide in spite of the clearance between the engaging protrusion 310 and the engaging hole 320, any residual shock or vibration transmitted to the lamp cover 230 is negligible compared to a direct transmission of that shock or vibration from the cavity 110, thus resulting in significantly less damage the lamp 210.

A coupling structure for a cavity 100 and a lighting assembly 200 of a cooking device in accordance with another embodiment will now be discussed with respect to FIG. 4.

This embodiment may prevent a shock or vibration transmitted through the cavity 100 from damaging the lamp 210 without the mounting assembly 300 described above with respect to FIGS. 1-3. As shown in FIG. 4, the blocking assembly 400 may be disposed between confronting surfaces of the cavity 100 and the circumference portion 232 of the lamp cover 230. The blocking assembly 400 may fill a gap between the circumference portion 232 and the cavity 100.

Figure 4:
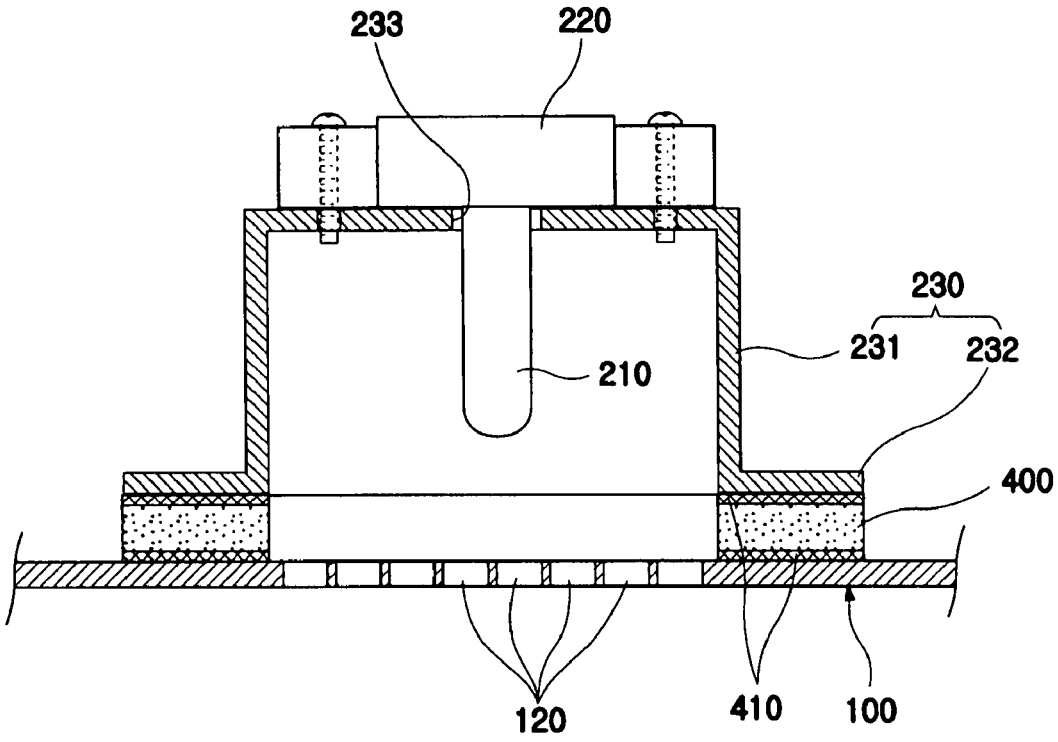
FIG. 4 is a sectional view of the lighting assembly coupled to the cavity in accordance with another embodiment as broadly described herein.

The blocking assembly 400 shown in FIG. 4 may be made of a resilient material, such as, for example, a sponge which is sufficiently thick allow the lamp cover 230 to float. For example, as shown in FIG. 4, a thickness of the blocking assembly 400 may be thicker than that of the circumference portion 232 of the lamp cover 230. Further, opposite surfaces of the blocking assembly 400 may be in close contact with and, in certain embodiments, fixed to the confronting surfaces of the cavity 100 and/or the circumference portion 232 of the lamp cover 230. Adhesive members 410, such as, for example, double sided tapes or adhesive, may be provided between the opposite surfaces of the blocking assembly 400 and the confronting surfaces of the cavity 100 and the circumference portion 232. In this manner, the blocking assembly 400 and the circumference portion 232 may be attached to each other, and the blocking assembly 400 and the cavity 100 may be also attached to each other.

Using a light assembly 200 and blocking assembly 400 as shown in FIG. 4, a shock or vibration exerted on the cavity 100 may be attenuated by the blocking assembly 400 through the resilient qualities of the blocking assembly 400, and damage to the lamp 210 may be prevented.

The mounting assembly for a cooking device and the blocking assembly for a cooking device in accordance with embodiments as broadly described herein make it possible to stably mount a lamp to a cavity of a cooking device and prevent the lamp from being damaged due an external shock exerted on the cavity.

The mounting assembly for a cooking device and the blocking assembly for a cooking device in accordance with embodiments as broadly described herein may prevent light emitted by a lamp from leaking to the outside through a gap between a lamp cover and a cavity of the cooking device.

A new type of cooking device is provided in which a lamp is prevented from being damaged even when an external shock is exerted on a cavity, and the light emitted from the lamp can be prevented from leaking to the outside of a lamp cover.

A cooking device as embodied and broadly described herein includes a cavity defining a cooking space; a lighting assembly for providing light into the cavity; and a mounting assembly for allowing the lighting assembly to float in a perpendicular direction and/or a horizontal direction with respect to an outer surface of the cavity and for coupling the lighting assembly to the outer surface of the cavity.

The lighting assembly may include a lamp, a lamp holder for supplying electric power to the lamp and a lamp cover which the lamp perforates and is accommodated in, the lamp holder being coupled to an outer surface of the lamp cover.

The mounting assembly may include an engaging protrusion having a protrusion section protruding from the outer surface of the cavity in a perpendicular direction thereto and a bending section bent at an end portion of the protrusion section; and a circumference portion formed along a periphery of the lamp cover and having an engaging hole formed thereon for the engaging protrusion to be engage to the engaging hole.

The engaging protrusion may be provided at each of both sides of the outer surface of the cavity to which the lamp cover is installed; and the engaging hole may be formed at the circumference portion of the lamp cover in correspondence to each engaging protrusion.

Both engaging holes may be formed in the shape of a slot to extend toward each other.

The engaging hole may have a width larger than a thickness or width of the protrusion section.

A gap between the outer surface of the cavity and the bending section may be larger than a thickness of the circumference portion.

The cooking device may also include a blocking assembly provided between opposite surfaces of the lighting assembly and the cavity to fill a gap between the cavity and the lighting assembly and to absorb a shock transmitted from the cavity to the lighting assembly.

The blocking assembly may be attached to at least one of the opposite surfaces of the lighting assembly and the cavity, and may include a cushion member, such as sponge.

In accordance with another embodiment as broadly described herein, there is provided a cooking device, including a cavity defining a cooking space; a lighting assembly for providing light into the cooking space of the cavity; and a blocking assembly provided between opposite surfaces of the lighting assembly and the cavity to fill a gap between the cavity and the lighting assembly and to allow the lighting assembly to float.

The lighting assembly may include a lamp, a lamp holder for supplying electric power to the lamp and a lamp cover which the lamp perforates and is accommodated in, the lamp holder being coupled to an outer surface of the lamp cover.

The blocking assembly may be provided between opposite surfaces of the lamp cover and the cavity.

Both surfaces of the blocking assembly may be in close contact with and fixed to the opposite surfaces of the lamp cover and the cavity, respectively.

The cooking device may also include adhesive members provided between both the surfaces of the blocking assembly and the opposite surfaces of the lamp cover and the cavity corresponding to each other, whereby they are in close contact with and fixed to each other.

The blocking assembly may include a cushion member, such as sponge.

The blocking assembly may have a thickness thicker than that of a circumference portion of the lamp cover.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking device, comprising:

a cavity that defines a cooking space;

a lighting assembly that selectively supplies light to the cavity, wherein the lighting assembly comprises:

a lamp;

a lamp holder that directs electric power to the lamp; and a lamp cover, wherein the lamp bolder is coupled to an outer surface of the lamp cover such that the lamp extends through an outer surface of the lamp cover and into an interior space defined by the lamp cover; and a mounting assembly that couples the lighting assembly to an outer surface of the cavity, wherein the mounting assembly allows a predetermined amount of movement of the lighting assembly relative to the outer surface of the cavity when so coupled, wherein the mounting assembly comprises:

at least one engaging protrusion having a protrusion portion that extends outward from the outer surface of the cavity and a bent portion that extends at an angle from a distal end of the protrusion portion; and at least one corresponding engaging hole formed in a circumference portion that extends along a periphery of the lamp cover, wherein the at least one the engaging hole engages the at least one engaging intrusion so as to couple the lamp cover to the cavity.

2. The cooking device as claimed in claim 1, wherein the predetermined amount of movement is in at least one of a horizontal direction or a vertical direction.

3. The cooking device as claimed in claim 1 wherein a gap between the outer surface of the cavity and the bent portion of the engaging portion is greater than a thickness of the circumference portion of the lamp cover.

4. The cooking device as claimed in claim 3, wherein a clearance between the bent portion of the engaging portion and the circumference portion of the lamp cover provides for movement of the lamp cover relative to the cavity in a direction perpendicular to a coupling direction of the lamp cover and the cavity.

5. The cooking device as claimed in claim 1, wherein an engaging protrusion is provided at each of two opposite sides of the outer surface of the cavity corresponding to where the lamp cover is mounted, and an engaging hole is formed at two opposite sides of the circumference portion of the lamp cover corresponding to each engaging protrusion.

6. The cooking device as claimed in claim 5, wherein the engaging holes are formed in the shape of elongated slots.

7. The cooking device as claimed in claim 5, wherein each engaging hole has a width that is greater than a thickness or a width of the protrusion portion of a corresponding engaging protrusion.

8. The cooking device as claimed in claim 7, wherein a clearance between the engaging hole and its corresponding engaging protrusion provides for movement of the lamp cover relative to the cavity in a direction parallel to a coupling direction of the lamp cover and the cavity.

9. The cooking device as claimed in claim 1, further comprising a blocking assembly provided between confronting surfaces of the lighting assembly and the cavity, wherein the blocking assembly fills a gap between the cavity and the lighting assembly and absorbs a shock transmitted from the cavity to the lighting assembly.

10. The cooking device as claimed in claim 9, wherein the blocking assembly is attached to at least one of the confronting surfaces of the lighting assembly and the cavity.

11. The cooking device as claimed in claim 9, wherein the blocking assembly is made of a resilient material.

12. The cooking device as claimed in claim 1, wherein the mounting assembly allows a predetermined amount of vertical movement of the lighting assembly relative to the outer surface of the cavity when so coupled.

13. The cooking device as claimed in claim 1, wherein the cooking device is at least one of a microwave oven, a convection oven, or a combination microwave/convection oven.

14. A cooking device, comprising:

a cooking cavity;

a lighting assembly movably coupled to the cavity to provide light to the cavity; and a mounting assembly that couples the lighting assembly to the cavity, comprising:

an engaging protrusion that extends outward from an outer surface of the cavity and includes a hook at its distal end; and a corresponding engaging hole formed in a portion of the lighting assembly corresponding to the engaging protrusion so as to engage the engaging protrusion and couple the lighting assembly to the cavity, wherein a width of the engaging hole is greater than a corresponding width of the engaging protrusion, and wherein a distance between the cavity and the hook is greater than a thickness of a portion of the mounting assembly secured therebetween.

* * * * *